United States Patent [19]

Winston

[11] Patent Number: 4,838,546

[45] Date of Patent: Jun. 13, 1989

[54] ANKLE EXERCISE WEIGHT

[76] Inventor: Edith Winston, 135 Hazelwood Dr., Jericho, N.Y. 11753

[21] Appl. No.: 191,397

[22] Filed: May 9, 1988

Related U.S. Application Data

[63] Continuation of Ser. No. 28,917, Mar. 23, 1987, abandoned, which is a continuation-in-part of Ser. No. 506,059, Jun. 20, 1983, abandoned.

[51] Int. Cl.[4] ..... A63B 21/12

[52] U.S. Cl. ..... 272/119

[58] Field of Search ..... 272/96, 119, 122, 67, 272/117

[56] References Cited

U.S. PATENT DOCUMENTS

| | | | |
|---|---|---|---|
| 3,114,982 | 12/1963 | McGowan | 272/119 X |
| 3,334,898 | 8/1967 | McCrory et al. | 272/119 |
| 3,366,380 | 1/1968 | Montour | 272/119 |
| 3,427,020 | 2/1969 | Montour et al. | 272/119 |
| 3,490,766 | 1/1970 | Gardner | 272/119 |
| 3,528,652 | 9/1970 | Tarbox | 272/119 |
| 3,588,105 | 6/1971 | Donohoe | 272/119 X |
| 3,924,851 | 12/1975 | Winston | 272/119 X |
| 4,322,072 | 3/1982 | White | 272/119 |
| 4,684,123 | 8/1987 | Fabry | 272/119 |

FOREIGN PATENT DOCUMENTS

| | | | |
|---|---|---|---|
| 1568081 | 5/1980 | United Kingdom | 272/119 |

*Primary Examiner*—Richard J. Apley
*Assistant Examiner*—Robert W. Bahr
*Attorney, Agent, or Firm*—Myron Amer

[57] ABSTRACT

A fabric body of a rectangular shape for encircling a user's ankle. The fabric is constructed with a plurality of side-by-side compartments, each having an opening thereinto to receive a weight, and comprising an inner and outer layer at least one of which is larger than the other so that the compartments are selectively collapsible and enlargeable so as to accommodate at least two weights.

1 Claim, 2 Drawing Sheets

12
30
50
38
34
32
28
22
40
26
42
52
54
24
44
14
6
7
20
5

ANKLE EXERCISE WEIGHT

RELATED APPLICATION

The present application is a continuation of application Ser. No. 028,917, filed Mar. 23, 1987, now abandoned, which is a continuation-in-part of application Ser. No. 506,059, filed June 20, 1983, now abandoned, for which all equitable rights are claimed.

BACKGROUND OF THE INVENTION

The present invention relates generally to an improved exercise ankle band, and more particularly to a band construction which permits the number of weights held within the band to be varied within a large range while simultaneously making the band more comfortable to the wearer.

In my aforementioned U.S. application, Ser. No. 506,059, I have disclosed an ankle exercising device adapted to make the exercise routine more strenuous, and thus more beneficial to muscle tone and other such objectives. It is advantageous to be able to vary the number of weights in the band, and thereby adjust the exercising weight. It is the object of the present invention to provide such an exercise device so that the number and disposition of the weights may be more readily varied providing a highly adjustable range of weights within a single band. Thus, as the user's muscles increase in strength, the same band may be used to increase the weight carried during subsequent exercise.

SUMMARY OF THE INVENTION

The weighted exercise band according to the present invention includes a rectangular fabric body of sufficient length to be wrapped about the user's ankle. A plurality of pocket-like compartments, each capable of holding at least two weights, are formed in the fabric body, each compartment having openings thereto located adjacent an edge of the fabric body.

The compartments are constructed between the walls of the fabric body, one of the walls having a larger dimension than the other, and folded over, in pleated fashion, providing bloused gussetted compartments, whereby each compartment can be enlarged to hold two or more weights, or folded to hold one or even none. A covering flap is secured along the fabric body edge which is adjacent to the compartment openings, such that the flaps have an operative position folded over the openings against the fabric body. The flap obviates inadvertent movement of said weights from the compartments during use of the exercise device.

Preferably, the compartments are divided into two sections, separated by a non-compartmental body section, and thus two flaps are also provided.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings.

DESCRIPTION OF THE INVENTION

Figure 1:
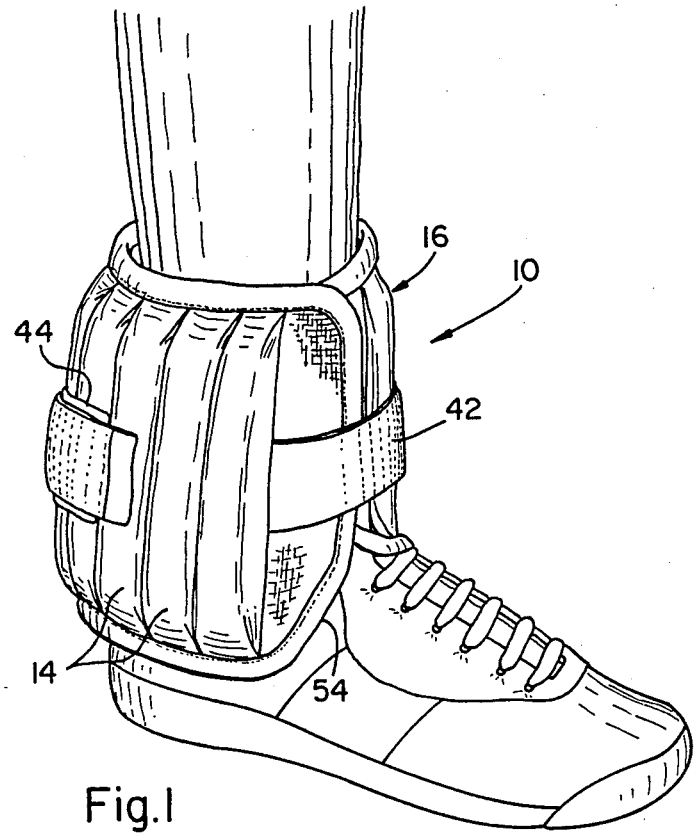
FIG. 1 is a perspective view illustrating the exercise device in its ankle-encircling position.

Reference is now made to the drawings wherein there is shown an ankle exercise device, generally designated 10, which as illustrated in FIG. 1 is adapted to be worn about the user's ankle. As explained within the aforementioned application, Ser. No. 506,059 which is incorporated herein by reference as more fully set forth, beneficial use of the device 10, as an exercising aid, is derived by inserting a selected number of cylindrically shaped weights, individually and collectively designated 12, in individual cooperating compartments 14 appropriately formed in a medial fabric body 16.

Figures 2, 3, 4:
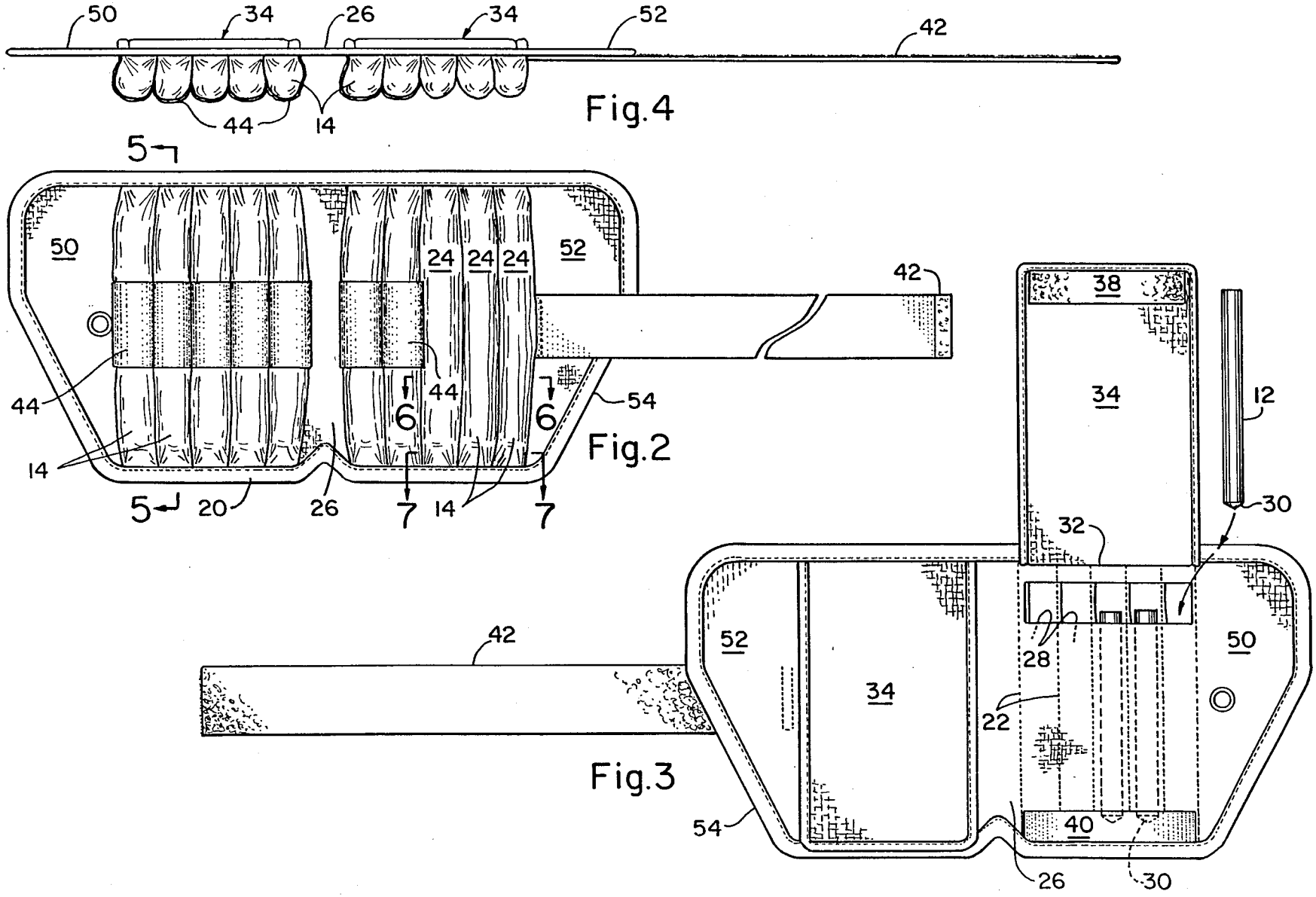
FIG. 2 is a side elevational view of the device illustrating the external surface thereof.
FIG. 3 is similarly a side elevational view, but illustrating the internal surface, or surface adjacent the user's ankle.
FIG. 4 is a top plan view illustrating the device.

As seen in detaile in FIGS. 2 and 3, the fabric body 16 is rectangular and is formed of an inner layer 17 and an outer layer 18 of conventional nature fiber fabric, man made fabrics, such as rayon, plastic or the like, or of similar sheet materials. The layers are attached to each other by piping 20 at least about their periphery. The outer layer is formed of substantially more material than the inner layer and is attached further along parallel lines 22 to the inner layer to form bloused gussets 24 corresponding to the compartments 14. Preferably, the compartments are divided into two sections (corresponding to the inner and outer side of the ankle and are separated by an ungusseted space 26. Attachment of the layers may be made by conventional sewing or heat welding or gluing, depending upon the nature of the fabric used in forming the body 16. In accordance with the present invention, outer layer is pleated so that each gusset 24 has opposite side panels (FIGS. 6 and 7) and a frontal panel foldable compactly against the inner layer. Thus each compartment holds at least two weights 12, being expandable sequentially as the weights are inserted into each pocket 14.

Figure 5:
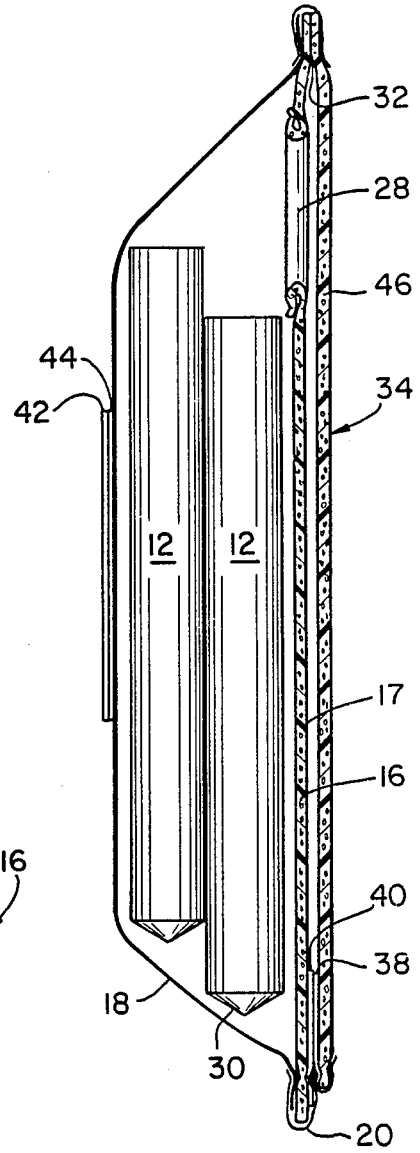
FIG. 5 is a sectional view, taken along line 5—5 of FIG. 2 showing further structural details.
Figure 6:
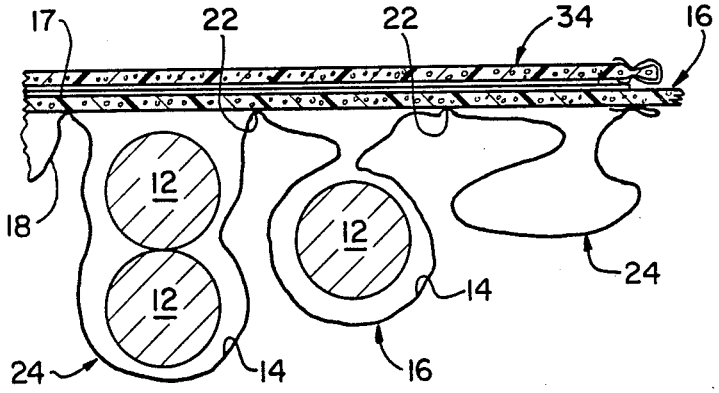
FIG. 6 is a sectional view taken along line 6—6 of FIG. 2.
Figure 7:
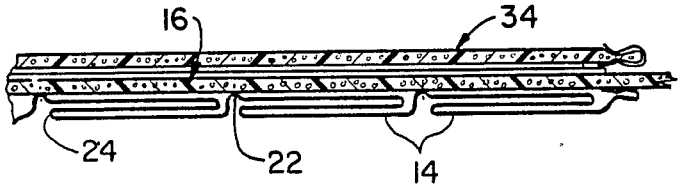
FIG. 7 in a sectional view taken along lines 7—7 of FIG. 2.

As seen in FIGS. 5–7, gussets 24 are made by providing excess material in the layer 18 along each of the vertical sides defining the compartment so that the gussets can billow selectively outward into expanded compartments (FIG. 6) while being capable of being folded on itself to be in substantially fixed flat condition when no weights are inserted therein (FIG. 7). The significance of the thus expandable compartments 14 is that more than one cooperating weight 12 can be inserted in a cooperating compartment 14, thereby providing the user of the device 10 with a wide choice of how heavy an exercise device 10 he wishes to use during an exercise routine, and exactly where the excess weight is to be placed.

Since the weights 12 are unattached to the device 10, to facilitate their easy insertion and removal, it is necessary, to avoid any of the weights 12, previously inserted in a cooperating compartment 14, from inadvertently coming out of its compartment during exercising movement. To this end, each compartment 14 has an appropriate opening 28 thereinto, through which the conical end 30 of each weight 12 is inserted in order to place the weight 12 within the compartment 14. The aforesaid openings 28 are strategically located adjacent the upper edge 32 of the fabric body 16. Along the same edge 32, device 10 is then provided with a pair of flaps 34, the edge of the flaps 34 and the edge 32 being connected by the appropriate edge finishing piping or the like. Each flap 34 is of course foldable, against the fabric body 16, both being provided with cooperating "VELCRO" pads 38 and 40 (FIG. 2). It will be readily appreciated that in its folded position. Flaps 34 function as a closure or cover over each of the compartment openings 18 respectively and, in this manner, assist in confining the weights 12 within the compartments 14.

The provision of a pair of flaps, sufficient merely to cover the individual pocket sections, results in a more compact, less bulky device as compared to a single flap covering the entire inner surface of the body. Further, the two flaps, cover only the lateral portions of the ankle leaving the achilles tendon and the instep more flexible.

In the illustrated embodiment, the device 10 maintained in its ankle-encircling position, as illustrated in FIG. 1, by cooperating "VELCRO" fasteners 42 and 44. As illustrated in FIGS. 2 and 4 component 42 consists of an elongated "VELCRO" strap connected, as by stitching or the like, to the body 16 so that the "VELCRO" thereon is in an exposed position, while component 44 comprise one or more "VELCRO" strips (FIG. 3), secured to on the exterior surface of the body 16 over the compartments 14. Engagement of the "VELCRO" strap 42 with the strips 44 is illustrated in FIG. 1.

Preferably the fabric body 16 and the flaps 24 are padded by providing an internal component or a panel of plastic foam 46 which, because of its resilient nature and its position in contact with the wearer's ankle, contributes, in an obvious manner, to the comfort of the user during the wearing of the device 10.

Specifically provided, as explained in aforementioned application, to effectively maintain a "high" position of each band 10 on the user's ankle are end form tongues or extensions 50 and 52. Each flap 50,52 has an upper horizontally oriented edge and coextensive portion which is an extension of the medial body portion 16 of each band forming an inverted V-shaped cut-out 54 which fits over a sneaker or athletic shoe, and thus holds the band in proper position of the user's ankle and/or foot portion which protrudes forwardly through the inverted V-shape 54.

As will be seen in FIG. 2, the space 26 left in the middle of the body 16, between the compartment sections coincides with the location of the user's Achilles tendon. Space 26 is foam padded, and because it is free of any weights, does not press against, and thus does not cause any physical damage or discomfort to the Achilles tendon. Similarly, it is to be noted that there are no weights 12 in the area of the front tongues 50 and 52. Thus, there are no weights which might might constrict mobility or otherwise interfere with flexing of the user's ankle.

A latitude of modification, change or substitution is intended in the foregoing disclosure, and in some instances, some features of the invention will be employed without a corresponding use of other features. Accordingly, it is appropriate that the appended claim be construed broadly and in a manner consistent with the spirit and scope of the invention herein.

What is claimed is:

1. An exercise device comprising one or more elongated cylindrical weights and a band for supporting said weights about a user's ankle, said band comprising a medial fabric body of a rectangular shape having a lengthwise extent sufficient to encircle the user's ankle, an arrangement of plural side-by-side compartments each having opposite side panels and a front panel bounding an opening thereinto located adjacent an edge of said fabric body, said compartments being arranged into two groups, each of said compartments supporting one or more weights placed therein, and being dimensioned to accommodate at least two of the weights therein in a length-abutting side by side orientation and having a construction including an expandable gusset folded inwardly of one of said side panels such that in the folded position of said gusset the compartment is collapsed to receive and embrace a first weight therein and upon unfolding of said gusset upon insertion of a second weight the compartment is expanded to receive and embrace the second weight therein, said gusset adjusting the volume of said compartment to accept and retain the weights inserted therein, a pair of weights-covering flaps, each of said flaps having a resilient plastic foam body secured along said fabric body edge adjacent said compartment openings of one of said compartments groups and having an operative position folded over said openings of said one of said groups against said fabric body and occupying an interposed position between said exercise device and the user's ankle, and a pair of end flaps having a substantially straight, upwardly inclined edge, said lengthwise extent of fabric body and end flaps being such that said end flaps abut and slightly overlap when the device is wrapped about the user's ankle, said upwardly inclined edges cooperating to form an inverted V-shaped space to receive the ankle of the user and contributing to holding said device in position upon the user.

* * * * *